US008127961B2

(12) United States Patent
Vovan

(10) Patent No.: US 8,127,961 B2
(45) Date of Patent: Mar. 6, 2012

(54) DOUBLE RIBBED SECURE CONTAINER

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 1029 days.

(21) Appl. No.: 12/075,549

(22) Filed: Mar. 12, 2008

(65) Prior Publication Data

US 2009/0120937 A1 May 14, 2009

Related U.S. Application Data

(60) Provisional application No. 61/002,672, filed on Nov. 10, 2007.

(51) Int. Cl.
*B65D 17/34* (2006.01)

(52) U.S. Cl. ..... 220/270; 220/212; 220/260; 220/266; 220/268; 220/269; 220/780; 220/783; 220/791

(58) Field of Classification Search ..... 220/212, 220/260, 266, 268, 269, 270, 780, 783, 791
See application file for complete search history.

(56) References Cited

U.S. PATENT DOCUMENTS

| | | | |
|---|---|---|---|
| 1,988,280 | A | 1/1935 | Levkoff |
| 2,567,013 | A | 9/1951 | Feinberg |
| 2,701,053 | A | 2/1955 | Tamarin |
| 3,572,579 | A | 3/1971 | Mueller |
| 3,773,207 | A | 11/1973 | Dokoupil et al. |

(Continued)

FOREIGN PATENT DOCUMENTS

| | | |
|---|---|---|
| DE | 7816353 | 11/1978 |

(Continued)

OTHER PUBLICATIONS

U.S. Appl. No. 12/327,759, filed Dec. 3, 2008.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

A container comprising a base (12) and lid (14) each formed of sheet plastic, wherein after food is loaded into a base cavity (20) and the lid is closed, the lid resists opening. To open the lid, a move-away tab (64) lying along the base rim portion (30) is moved by tearing along at least one line (70) so a lid rim part (50) is exposed and can be grasped to lift the lid. The base has an outer raised rib (32) that blocks access to the lid rim part until the tab, which lies between two gaps (62, 63) in the outer rib, is moved out of the way. The base also has an inner raised rib (34) that projects into a groove (46) in the lid to form a seal.

20 Claims, 15 Drawing Sheets

U.S. PATENT DOCUMENTS 3,860,148 A 1/1975 Sherin
3,933,296 A 1/1976 Ruskin et al.
3,941,248 A 3/1976 Moser et al.
3,955,742 A 5/1976 Marshall et al.
3,984,025 A 10/1976 Khoury
4,060,176 A 11/1977 Tobiasson
4,113,136 A 9/1978 Abbott
4,139,121 A 2/1979 Roccaforte
4,262,814 A 4/1981 Roccaforte
4,520,943 A 6/1985 Nielsen
4,555,043 A 11/1985 Bernhardt
4,560,082 A 12/1985 Sutch
4,569,443 A 2/1986 Roccaforte
4,610,371 A 9/1986 Karkiewicz
4,627,550 A 12/1986 Dines
4,671,453 A 6/1987 Cassidy
4,721,210 A 1/1988 Lawrence et al.
4,742,935 A 5/1988 Schellenberg
4,782,977 A 11/1988 Watanabe et al.
4,785,963 A 11/1988 Magley
4,819,824 A 4/1989 Longbottom et al.
4,881,656 A 11/1989 Chumley et al.
4,930,656 A 6/1990 Blanchette
4,966,292 A 10/1990 Marino et al.
4,974,735 A 12/1990 Newell et al.
4,990,345 A 2/1991 Webb
5,002,198 A 3/1991 Smith
5,007,231 A 4/1991 Ingemann
5,027,969 A 7/1991 Lesquir
5,040,695 A 8/1991 Adams et al.
5,052,572 A 10/1991 Pherigo
5,092,479 A 3/1992 Wells
5,111,953 A 5/1992 Faust et al.
5,111,954 A 5/1992 Gaudreault
5,115,934 A 5/1992 Nelson
5,129,531 A 7/1992 Beck et al.
5,131,551 A 7/1992 Wells
5,133,470 A 7/1992 Abrams et al.
5,163,575 A 11/1992 Luch et al.
5,170,905 A 12/1992 Luch
5,219,087 A 6/1993 Christensson
5,249,694 A 10/1993 Nelson
5,251,758 A 10/1993 Kolacek
5,283,940 A 2/1994 Luch et al.
5,300,748 A 4/1994 Colombo
5,303,839 A 4/1994 Blumenschein
5,307,948 A 5/1994 Blackburn et al.
5,437,386 A 8/1995 Von Holdt
5,507,406 A 4/1996 Urciuoli et al.
5,511,679 A 4/1996 Beck
5,528,814 A 6/1996 Luch et al.
5,573,134 A 11/1996 Chenault et al.
5,626,251 A 5/1997 Luburic et al.
5,772,110 A 6/1998 Garretson
5,785,203 A 7/1998 Arshinoff et al.
5,788,105 A 8/1998 Foos
5,871,147 A 2/1999 Smith et al.
5,875,913 A 3/1999 Letica
5,890,648 A 4/1999 Cai
5,931,291 A 8/1999 Sedon et al.
5,931,332 A 8/1999 Mygatt et al.
5,979,690 A 11/1999 Hartley
6,000,570 A 12/1999 Nelson
6,045,038 A 4/2000 Smith et al.
RE36,729 E 6/2000 Luch et al.
6,116,450 A 9/2000 Huang
6,193,921 B1 2/2001 Nelson
6,257,435 B1 7/2001 Chedister et al.
6,279,774 B1 8/2001 Clute et al.
6,328,355 B1 12/2001 Bortz
6,491,164 B1 12/2002 Virvo
6,572,909 B1 6/2003 Bagwell et al.
6,604,645 B1 8/2003 Vaupotic
6,604,646 B2 8/2003 Torniainen et al.
6,877,631 B1 4/2005 Thompson et al.
6,899,245 B1 5/2005 Nelson
7,004,314 B2 2/2006 Pucillo et al.
7,073,680 B2 7/2006 Boback et al.
7,097,043 B2 8/2006 Hsu
7,118,003 B2 10/2006 Sellari et al.
7,140,211 B2 11/2006 Tremblay
7,172,109 B2 2/2007 Kuenstler et al.
7,235,207 B2 6/2007 Gregory et al.
7,311,218 B2 12/2007 Varadarajan
7,325,676 B2 2/2008 Galaz
7,661,547 B2 2/2010 Richir
7,694,837 B2 4/2010 Robertson et al.
7,757,848 B2 7/2010 Gelardi et al.
2002/0088814 A1 7/2002 Belfance
2002/0170914 A1 11/2002 Witt
2003/0029868 A1 2/2003 Davidof et al.
2003/0127419 A1 7/2003 Shenkar et al.
2003/0160051 A1 8/2003 Ciccone
2003/0189048 A1 10/2003 Luburic
2004/0026286 A1 2/2004 Ramsey
2004/0045867 A1 3/2004 Applebaum
2004/0094548 A1 5/2004 Laveault
2004/0108370 A1 6/2004 Lee
2004/0118848 A1 6/2004 Marshall
2004/0200839 A1 10/2004 Conti
2004/0200891 A1 10/2004 Correll
2005/0017007 A1 1/2005 Sellari et al.
2005/0061861 A1 3/2005 Pennino
2005/0145628 A1 7/2005 Schwarz
2005/0161455 A1 7/2005 Studee
2005/0173435 A1 8/2005 Wellman et al.
2005/0184070 A1 8/2005 Boback et al.
2005/0236413 A1 10/2005 Maciag et al.
2005/0252916 A1 11/2005 Varadarajan
2006/0003879 A1 1/2006 Buchman
2006/0006178 A1 1/2006 Foldesi et al.
2006/0011632 A1 1/2006 Caille
2006/0016821 A1* 1/2006 Liu ..... 220/780
2006/0144874 A1 7/2006 Solowiejko
2006/0163265 A1 7/2006 De Candido
2006/0201946 A1 9/2006 Witt
2006/0261070 A1 11/2006 Robertson et al.
2006/0266750 A1 11/2006 Lesquir
2006/0289541 A1 12/2006 Boback et al.
2006/0289549 A1 12/2006 Vovan
2007/0062948 A1 3/2007 Albrecht et al.
2007/0095848 A1 5/2007 Galland et al.
2007/0108210 A1 5/2007 Alvares et al.
2007/0138180 A1 6/2007 Vovan
2007/0164026 A1 7/2007 Morrissey et al.
2007/0202221 A1 8/2007 Hinze et al.
2008/0000904 A1 1/2008 Vovan
2008/0006632 A1 1/2008 Vovan
2008/0185383 A1 8/2008 Philippe et al.
2008/0199108 A1 8/2008 Rogers
2009/0021026 A1 1/2009 Collier
2009/0032545 A1 2/2009 Zeiler et al.
2009/0057313 A1 3/2009 Alvares
2009/0120936 A1 5/2009 Zauser et al.
2009/0120942 A1 5/2009 Vovan

FOREIGN PATENT DOCUMENTS

DE 4418935 12/1995
DE 29819718 1/1999
DE 29914659 U1 8/1999
EP 0752374 1/1997
EP 1736417 12/2006
FR 2691952 12/1993
FR 2819496 7/2002
GB 2257118 1/1993
WO WO 2005/082733 9/2005
WO WO2005082734 9/2005

OTHER PUBLICATIONS

U.S. Appl. No. 12/327,759, Jan. 21, 2011 Non-Final Office Action.
U.S. Appl. No. 11/857,144, filed Sep. 18, 2007.
U.S. Appl. No. 11/879,168, filed Jul. 16, 2007.
U.S. Appl. No. 11/857,144, filed Sep. 18, 2007.
U.S. Appl. No. 12/432,627, filed Apr. 29, 2009.
U.S. Appl. No. 11/315,654, filed Dec. 21, 2005.
U.S. Appl. No. 12/327,759 (previously cited), filed Dec. 3, 2008.

U.S. Appl. No. 11/857,144, Apr. 7, 2011 Response to Non-Final Office Action.
U.S. Appl. No. 11/857,144, Jan. 7, 2011 Non-Final Office Action.
U.S. Appl. No. 11/857,144, Oct. 19, 2010 Response to Restriction Requirement.
U.S. Appl. No. 11/857,144, Sep. 20, 2010 Restriction Requirement.
U.S. Appl. No. 11/879,168, Apr. 26, 2011 Advisory Action.
U.S. Appl. No. 11/879,168, Mar. 10, 2011 Response to Final Office Action.
U.S. Appl. No. 11/879,168, Dec. 10, 2010 Final Office Action.
U.S. Appl. No. 11/879,168, Sep. 14, 2010 Response to Non-Final Office Action.
U.S. Appl. No. 11/879,168, Jun. 10, 2010 Non-Final Office Action.
U.S. Appl. No. 11/857,144, Apr. 7, 2011 Response to Non-Final Office Action.
U.S. Appl. No. 11/857,144, Jan. 7, 2011 Non-Final Office Action.
U.S. Appl. No. 11/857,144, Oct. 19, 2010 Response to Restriction Requirement.
U.S. Appl. No. 11/857,144, Sep. 20, 2010 Restriction Requirement.
U.S. Appl. No. 12/432,627, Apr. 15, 2011 Notice of Allowance.
U.S. Appl. No. 12/432,627, Mar. 25, 2011 Response to Final Office Action.
U.S. Appl. No. 12/432,627, Jan. 26, 2011 Final Office Action.
U.S. Appl. No. 12/432,627, Dec. 22, 2010 Response to Non-Final Office Action.
U.S. Appl. No. 12/432,627, Aug. 24, 2010 Non-Final Office Action.
U.S. Appl. No. 12/432,627, Aug. 9, 2010 Response to Restriction Requirement.
U.S. Appl. No. 12/432,627, Jul. 8, 2010 Restriction Requirement.
U.S. Appl. No. 11/315,654, Jan. 19, 2011 Amendment and Request for Continued Examination (RCE).
U.S. Appl. No. 11/315,654, Oct. 19, 2010 Final Office Action.
U.S. Appl. No. 11/315,654, Jul. 26, 2010 Response to Restriction Requirement.
U.S. Appl. No. 11/315,654, Jun. 25, 2010 Restriction Requirement.
U.S. Appl. No. 12/327,759, Apr. 21, 2011 Response to Non-Final Office Action.
U.S. Appl. No. 11/879,168, Jun. 27, 2011 Notice of Allowance.
U.S. Appl. No. 11/879,168, Jun. 10, 2011 Notice of Appeal.
U.S. Appl. No. 11/879,168, Jun. 9, 2011 Response to Final Office Action.
U.S. Appl. No. 11/857,144, Sep. 21, 2011 Response to Non-Final Office Action.
U.S. Appl. No. 11/857,144, Jun. 21, 2011 Non-Final Office Action.
U.S. Appl. No. 12/327,759, Aug. 11, 2011 Final Office Action.
U.S. Appl. No. 12/432,627, Jul. 29, 2011 Non-Final Office Action.
U.S. Appl. No. 12/432,627, Jul. 15, 2011 Amendment after Notice of Allowance and Request for Continued Examination (RCE).
U.S. Appl. No. 11/879,168, Sep. 27, 2011 Issue Fee paid.
U.S. Appl. No. 12/220,017, Oct. 19, 2011 Non-Final Office Action.

* cited by examiner

DOUBLE RIBBED SECURE CONTAINER

CROSS-REFERENCE

Applicant claims priority from U.S. provisional patent application Ser. No. 61/002,672 filed Nov. 10, 2007.

BACKGROUND OF THE INVENTION

Food is often placed in a transparent plastic container that includes a base with a large volume cavity that holds the food and with a lid that closes the cavity. Buyers want to be assured that, after the food was placed in the container as by a clerk at the food store, that the container has not been opened. There is a possibility that another customer has secretly opened the container to taste a bit of the food before closing it (and possibly leaving germs). Potential customers want to be assured that this has not happened.

Most lids have a periphery that is constant throughout the entire 360° periphery of the lid, and with the entire lid lying on top of a portion of the base, rather than inside the base. A container that could be easily closed by a clerk at a store after he/she loaded food into the base cavity, which automatically latched the lid closed so it required a customer to tear an exposed portion of the container to open the lid, and which formed a seal between the base and lid without the lid having to move down into the base cavity, would be of value.

SUMMARY OF THE INVENTION

In accordance with one embodiment of the present invention, a container is provided of the type that includes a sheet plastic base and lid which prevents the lid from opening the first time unless a barrier is broken, wherein the lid periphery has a simple outer lid rim part extending along almost its entire periphery and wherein the lid seals to the base without requiring the lid to be inserted into the base cavity. The base has a raised base outer rib extending along almost the entire base periphery and has a flat base seal wall inward of the base outer rib. The lid has a lid rim part with a radially (with respect to the container axis) outer rim part that lies flat against the flat base seal wall and with an outer edge that lies substantially against the base outer rib. As a result, the base outer rib prevents a person from grasping the lid rim part to lift the lid. However, there are two gaps in the base outer rib, with means in the gaps for moving a tab that includes a limited length of the base outer rib. When the tab is moved out of the way, a person can grasp the lid rim part and lift the lid.

To seal the base to the lid, the base is provided with an upstanding projection lying radially inside the base outer rib, and the lid is provided with a downwardly-opening groove that receives the projection and seals to it. The projection has primarily vertical inner and outer walls and the groove has inner and outer walls that receive the projection. The inner and outer walls of the projection and groove are closer together at the bottom than at the top, to provide a seal and to resist opening of the container.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
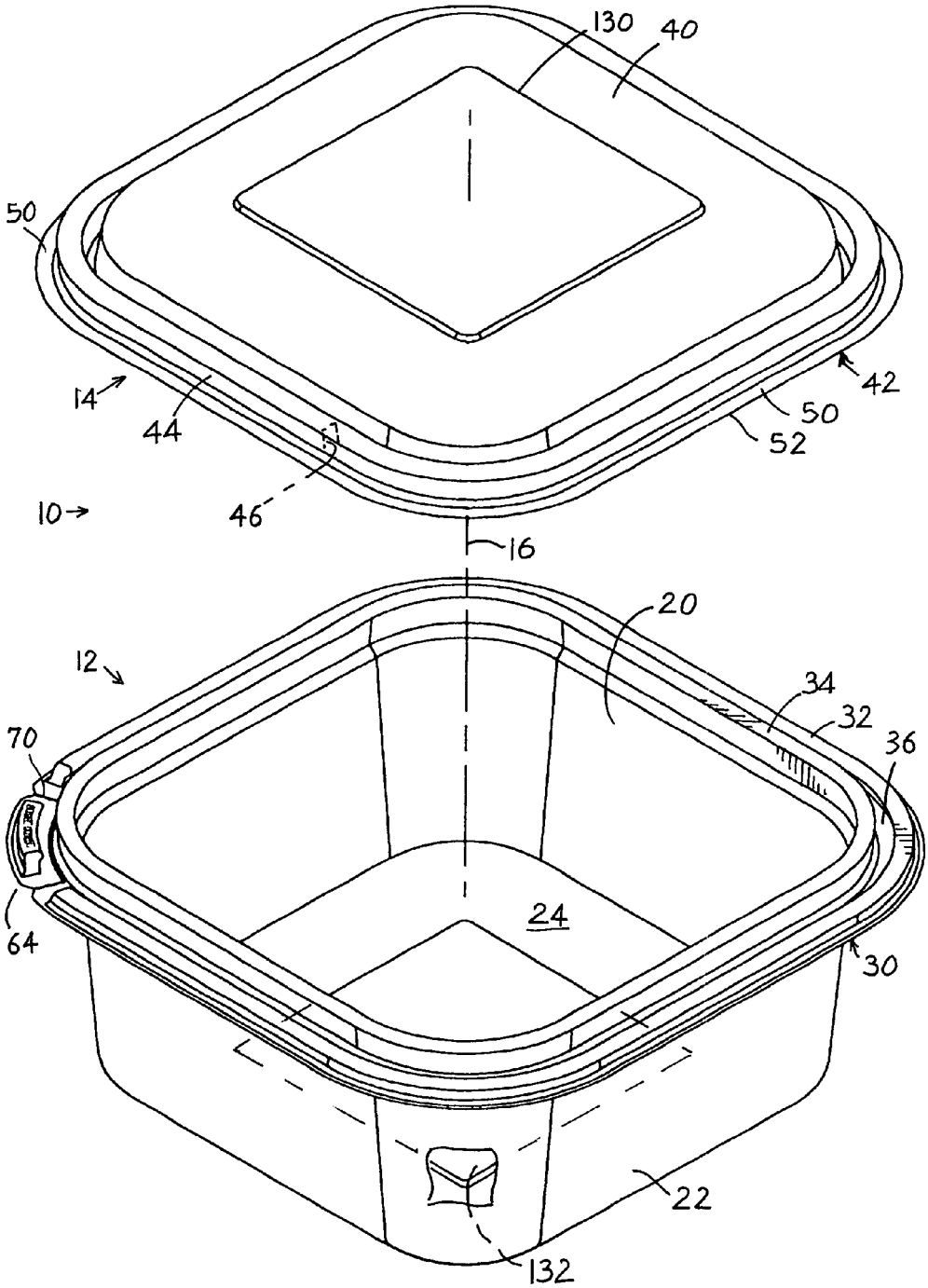
FIG. 1 is an exploded isometric view of a container of the invention, with the lid spaced over the base.

FIG. 1 shows a container 10 that includes base and lid elements comprising a base 12 and a cover or lid 14, that are centered on a vertical axis 16. The base has a cavity 20 with primarily vertical side walls 22 and a bottom wall 24. The base also has a base rim portion 30 that overhangs the side walls (i.e. the rim portion extends radially further from the axis than adjacent upper ends of the side walls 22). It can be seen that the base rim portion has a raised base outer rib 32 that extends around at least three-quarters, or 270°, of the axis and that forms an upward projection part. The base rim portion 30 also has a raised base inner rib 34 that forms an upward projection, and the base rim portion also has a horizontal base support wall 36 that lies radially between the inner and outer ribs 34, 32.

The lid 14 has a center portion 40 that lies over most of the cavity when the container is closed, and has a lid rim portion 42 that lies radially outward of the center portion. The lid rim portion forms a lid groove rib 44 that forms a downward opening groove 46. The lid rim portion 42 also has a lid outer rim part 50 with an outer edge 52, and that lies on the base support wall 36 when the container is closed.

Figure 2:
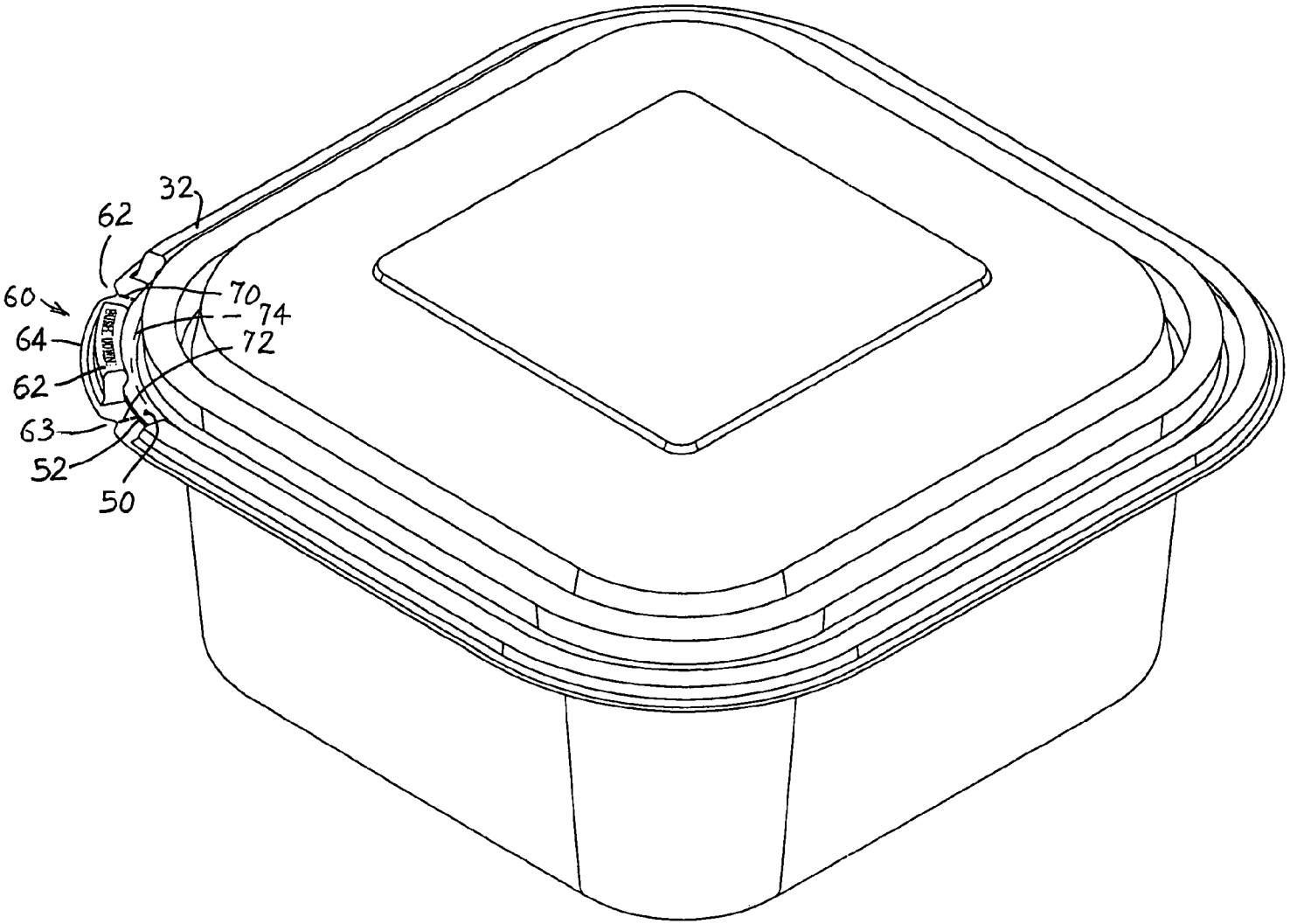
FIG. 2 is an isometric view of the container of FIG. 1 with the lid fully closed on the base.
Figure 3:
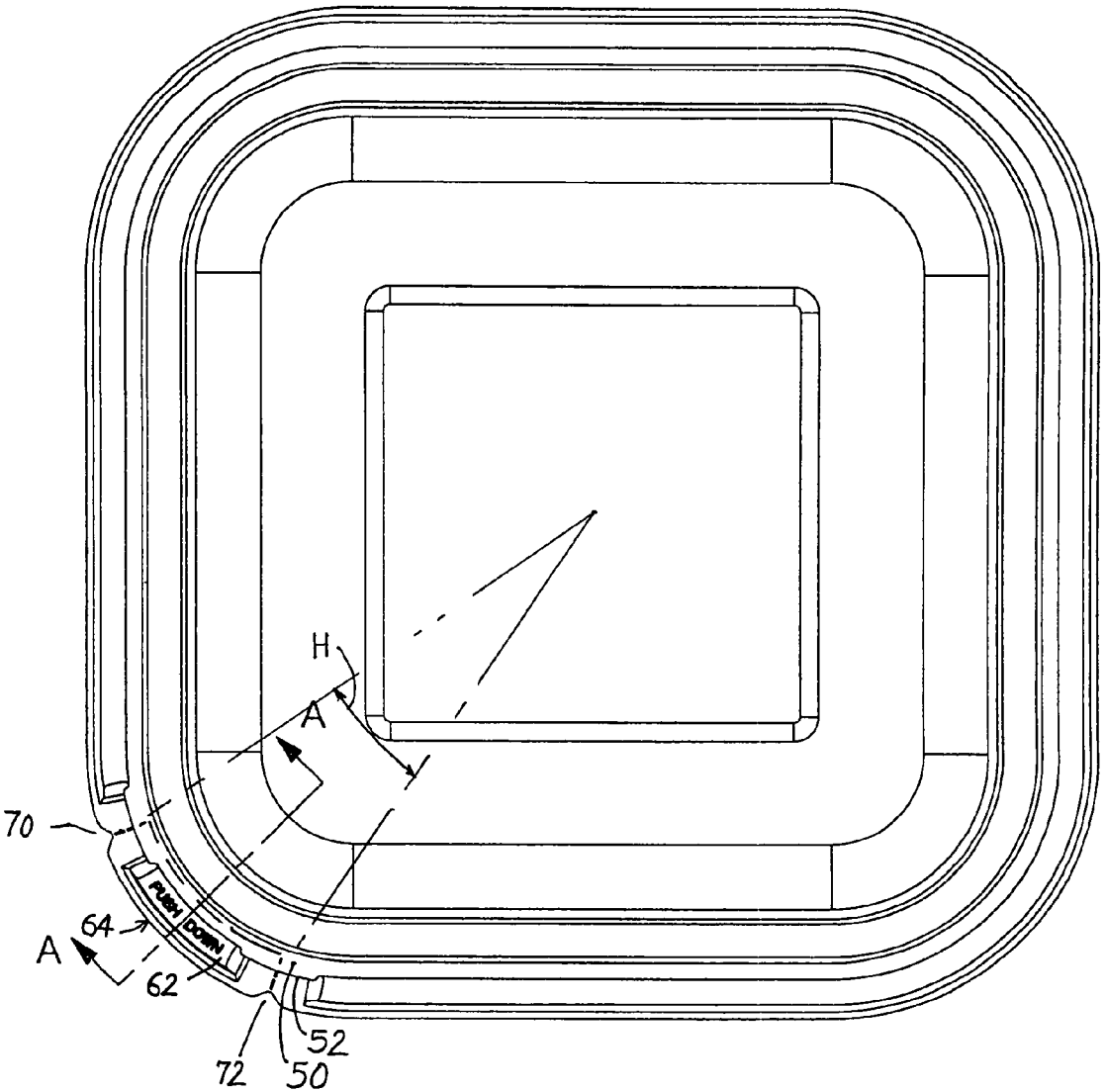
FIG. 3 is a plan view of the container of FIG. 2.

FIG. 2 shows the closed container, and shows an access region 60 where there are two gaps 62, 63 in the base outer rib 32 and a move-away tab 64 that spans most of the access region. The tab subtends an angle H of about 20° to 30°. To open the container a person must raise the lid rim part 50 by first lifting the lid outer edge 52. A base outer rib part 62 on the tab blocks access to the lid outer edge 52. The tab 64 is connected to the rest of the base rim portion 36 by a pair of gap lines 70, 72 that lie in the gaps at either end of the tab. The base has a separation line 74 that lies radially inward of the base outer rib. A customer who buys the food package can open it by tearing one end of the tab along a tear line such as 70, so the tab can be moved out of the way. Then, the customer can grasp the lid rim part 52 to lift the lid and open the base cavity.

Figure 5:
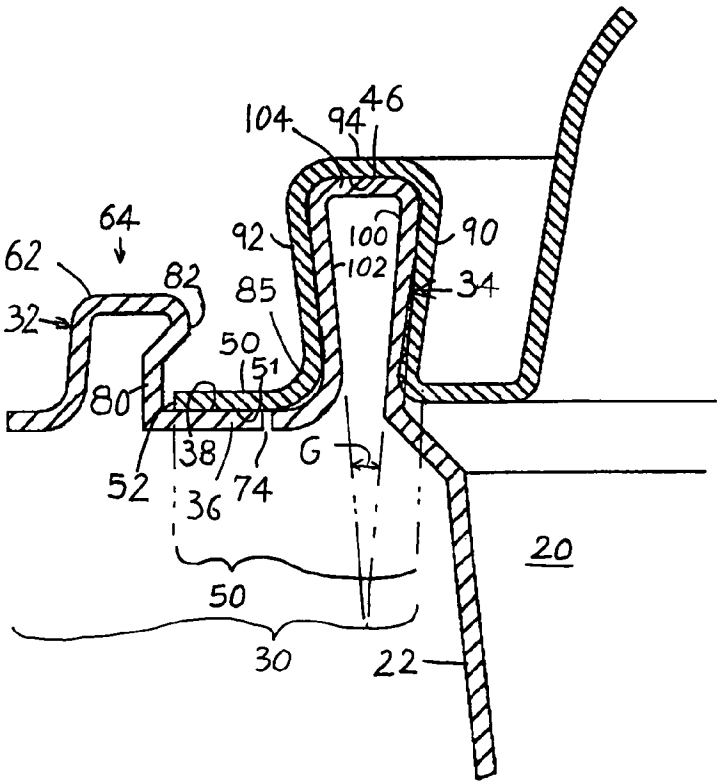
FIG. 5 is an enlarged view of area B-B of FIG. 4.
Figure 4:
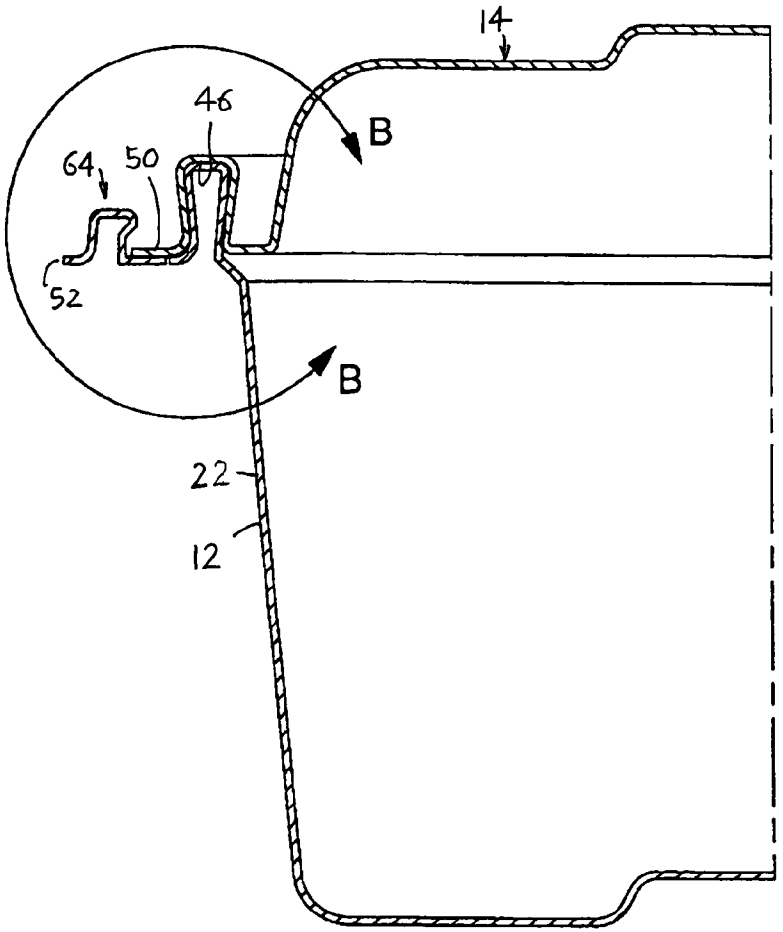
FIG. 4 is a sectional view taken on line A-A of FIG. 3.
Figure 6:
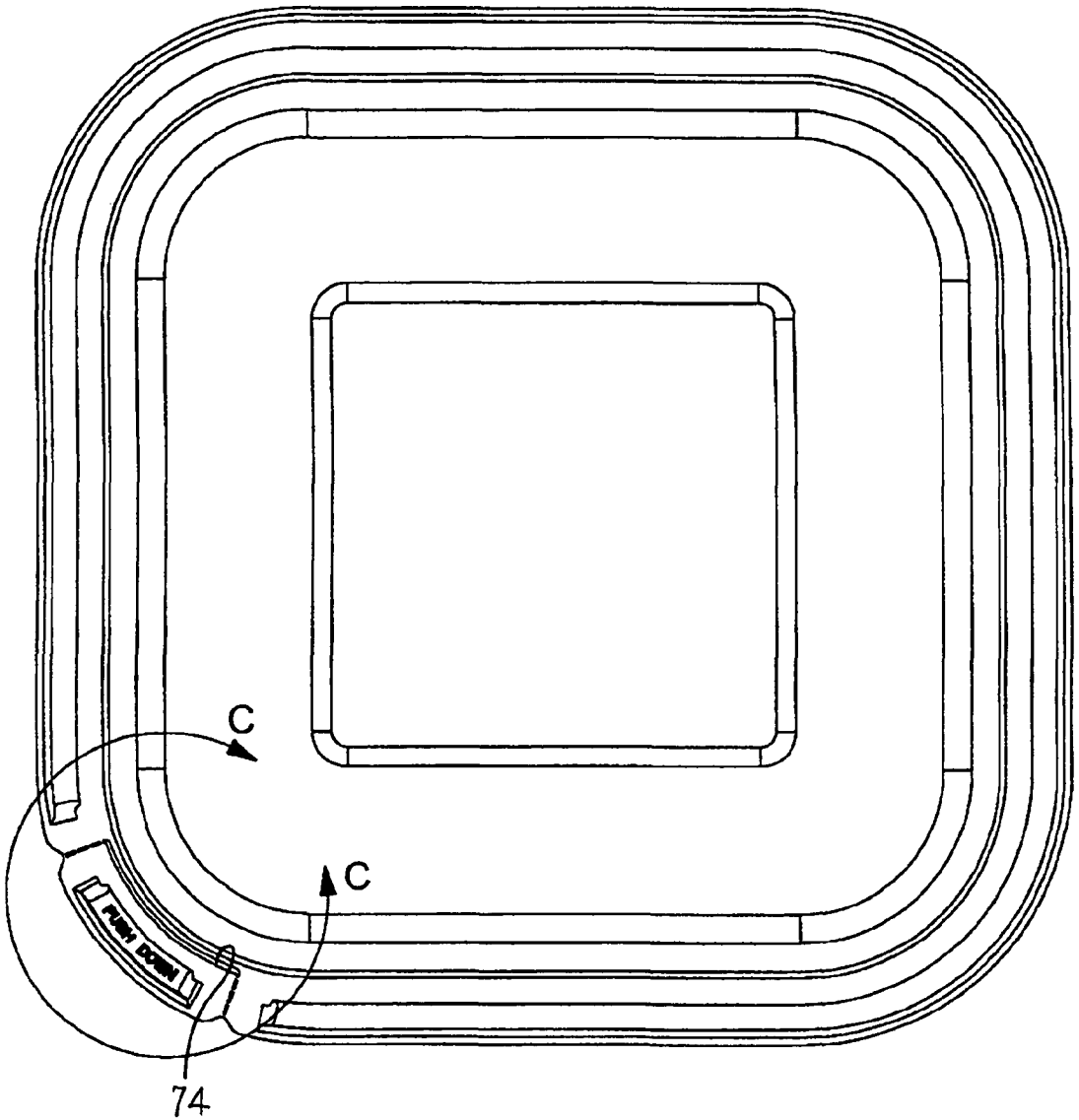
FIG. 6 is a plan view of only the base of FIG. 1.

FIGS. 4 and 5 show the closed container at the tab 64, showing the lid rim portion which includes the lid groove 46, the lid rim part 50 which extends beyond the base side walls 22 and the lid rim outer edge 52. FIG. 5 shows that the base outer rib part 62 has a radially inner wall 80 with an overhang 82 that makes the inner surface of the inner wall vertically undercut. That is, when an attempt is made to lift the lid outer edge 52, such lifting is impeded by the overhang 82. As a result, it requires more force to lift the lid to deflect the lid rim part 50 so it can clear the overhang 82, and a person must have a firm grasp of the lid rim to do so. The separation line 74 at the radially inner end of tab 64 is a narrow line of a radial width that is preferably no more than one millimeter, to prevent a person from pushing up the lid rim part 50 by projecting a narrow instrument through the slit of the separation line. The overhang 82 also prevents a person from inserting a fingernail along the inner wall to bend up the lid outer edge 52. It can be seen that the separation line 74 is spaced a plurality of millimeters radially inward of the lid outer edge 52, to facilitate grasping the lid when the tab is moved out of the way.

FIG. 5 shows that the upper surface 38 of the base support wall 36 is flat, and that the bottom surface 51 of the lid rim part 50 is also flat and extends parallel to and adjacent to the surface 38 (as viewed radially or circumferentially). This makes it difficult for a person to lift the lid rim part 50 until the tab is moved to move the base support wall 36 downward and leave the bottom of lid rim part 50 exposed. A lid groove wall 92 is joined by a resilient curve 85 to the lid rim part 50 and presses the lid rim part 50 firmly against the base support wall 36.

FIG. 5 shows that the downwardly-opening lid groove 46 is formed by radially inner and outer groove walls 90, 92 and a top wall 94. The upward projection formed by the base inner rib 34 also has radially inner and outer rib walls 100,102 and a top wall 104. When the base inner rib is pushed upward into the groove, the radially inner and outer walls of the base rib and lid groove tightly engage one another to form a seal. The seal resists the passage of fluids such as air that would reduce the freshness of the food. The radially inner and outer walls of the base inner rib and of the lid groove, converge downwardly at an angle G of a plurality of degrees but less than 60°, with a preferred angle being about 20°. The angling from the vertical results in the opposite side walls of a part such as the base rib walls 100, 102, converging in a downward direction. This convergence at an angle of a plurality of degrees facilitates the lid groove walls pressing firmly against the base inner rib walls, and also provides resistance to opening the lid. The seal between the base and lid occurs at the top of the lid and above the food-holding cavity 20, rather than at a location within the food-holding cavity 20, so the sealed surfaces are unlikely to be contaminated by the food if the cavity has been overfilled.

Figure 8:
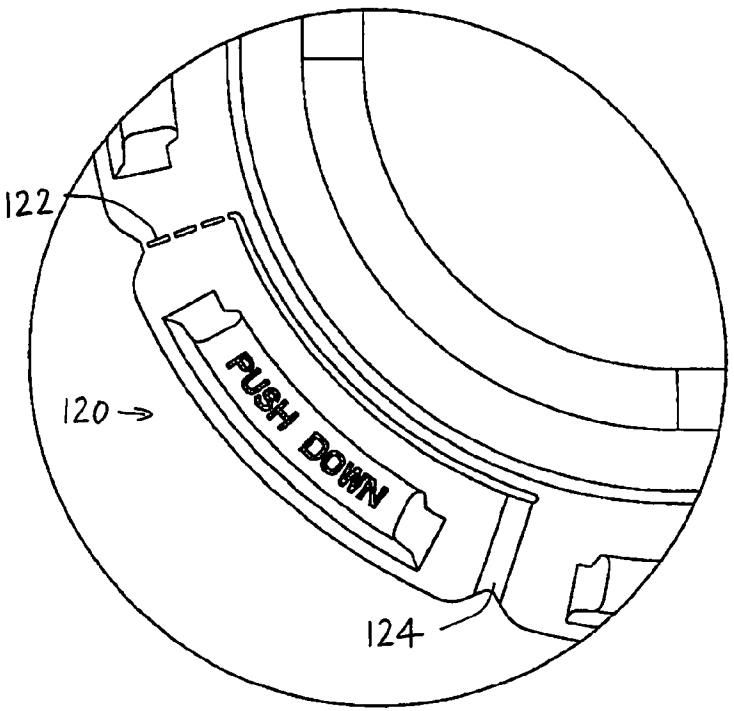
FIG. 8 is a plan view of an area of a variation of the invention of FIG. 1 wherein one gap line is a hinge rather than a tear line.
Figure 7:
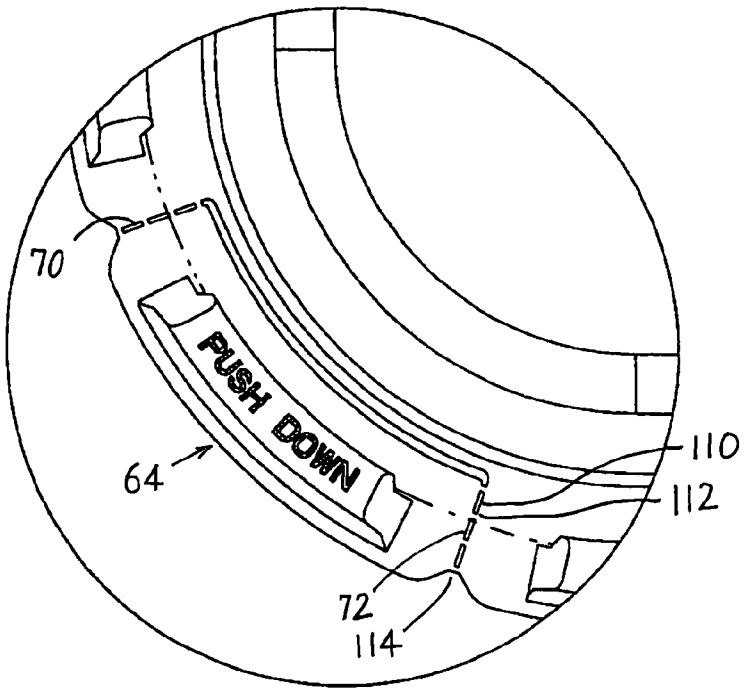
FIG. 7 is a plan view of area C-C of FIG. 6.
Figure 10:
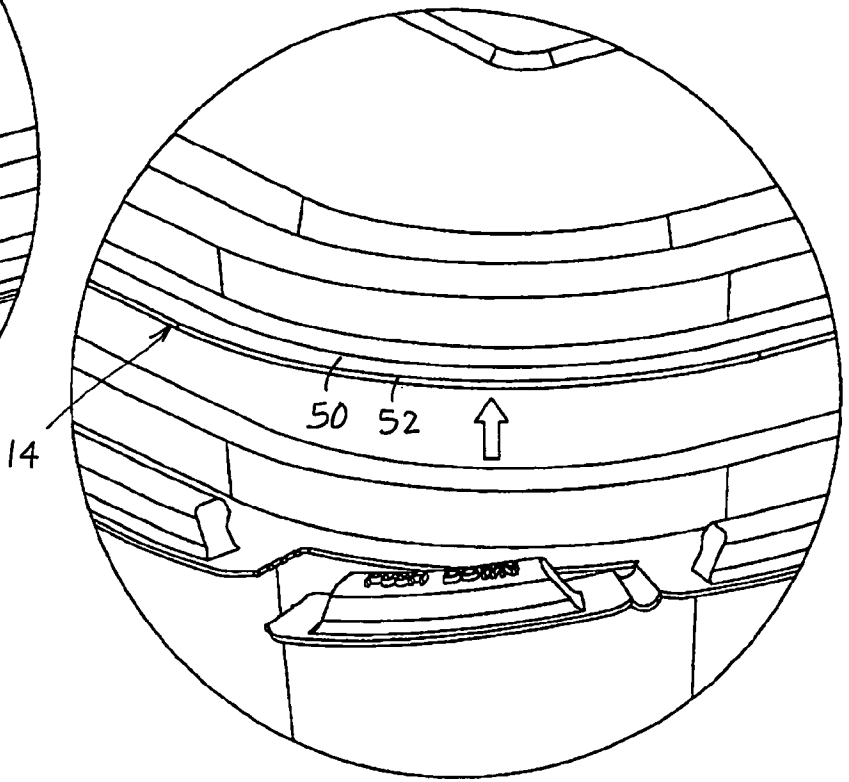
FIG. 10 is a view similar to that of FIG. 9 but with the lid having been raised.
Figure 9:
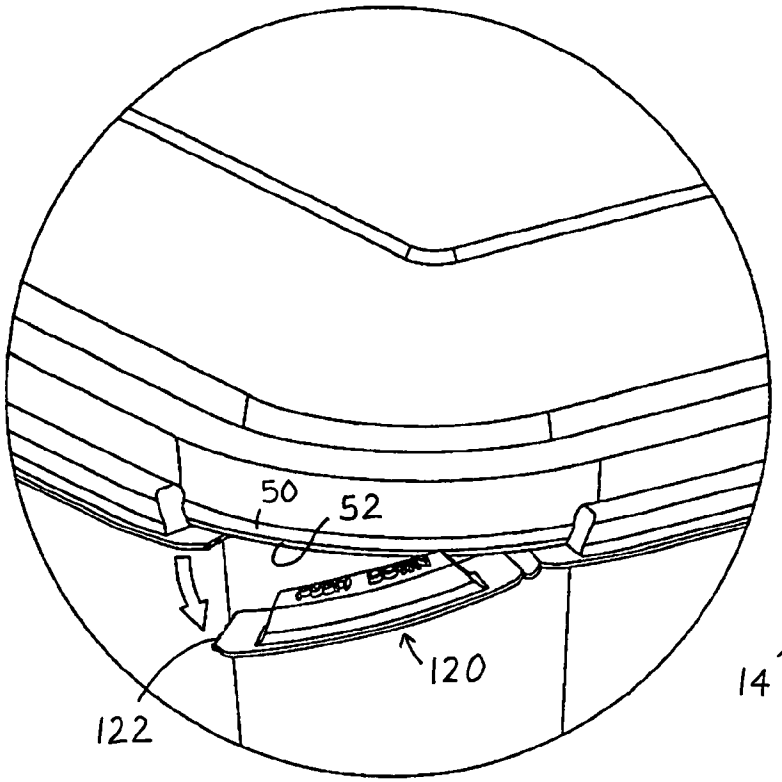
FIG. 9 is a partial isometric view of the container of FIG. 7 wherein the tab has been moved out the way but the lid has not yet been opened.

FIG. 7 shows that both gap lines 70, 72 are designed to be easily torn, by providing a plurality of elongated slits 110 and shorter connections 112 and by providing lead-ins 114. It is also possible to provide a scored line that facilitates tearing. It is necessary to tear only one of the two tear lines 70, 72 to pivot the tab out of the way about the other tear line. FIG. 8 shows a modified tab 120 which is connected at the gaps at its opposite ends by one tear line 122 and by one pivot line that forms a hinge 124 that cannot be easily torn. FIGS. 9 and 10 show how a tear line 122 can be torn and the tab 120 can be pivoted out of the way so a person can grasp the lid rim part 50 to pull up the lid with a sufficient upward force (e.g. 2 pounds) to open the lid.

FIG. 1 shows that the center portion 40 of the top of the lid which lies over the cavity 20, has an upward projection 130 and that the bottom wall 24 of the base has a recess 132 in its bottom. This allows a plurality of closed containers to be stacked one on another, without requiring a plurality of projections and recesses to be aligned.

Figure 11:
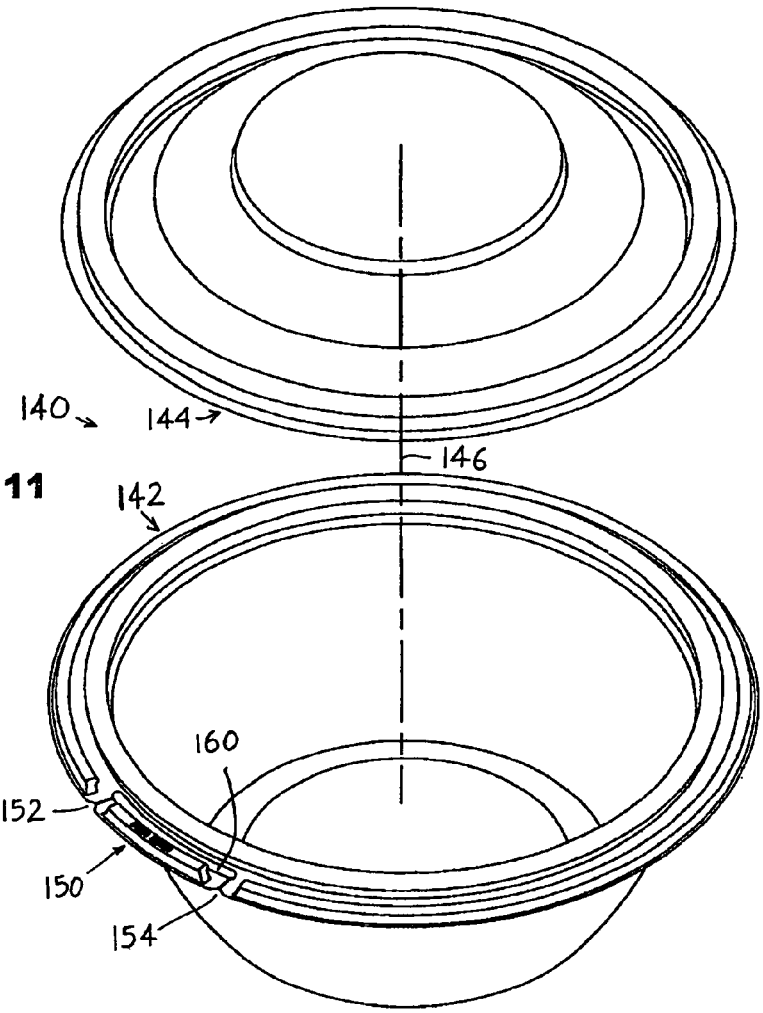
FIG. 11 is an exploded isometric view of a container of a different shape (round periphery).
Figure 12:
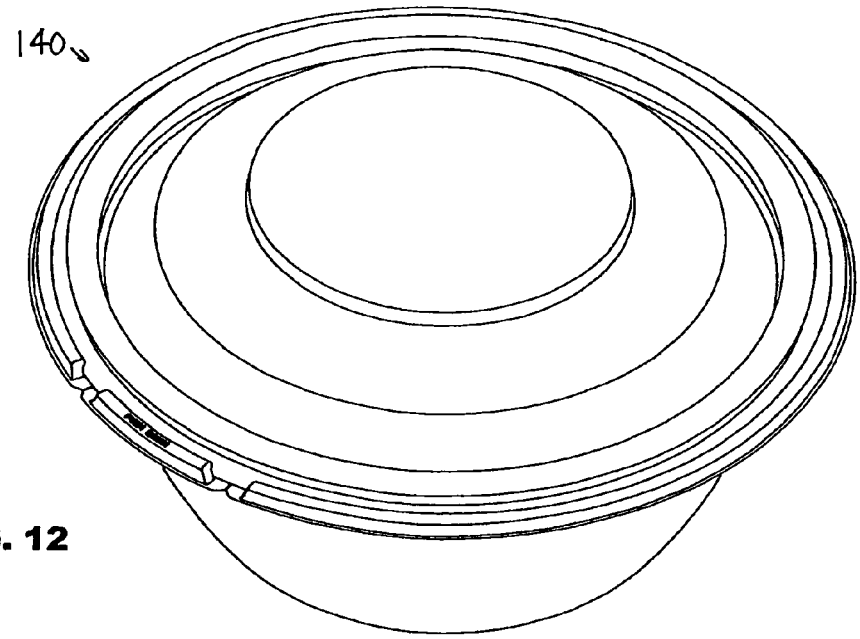
FIG. 12 is an isometric view of the closed container of FIG. 11.
Figure 13:
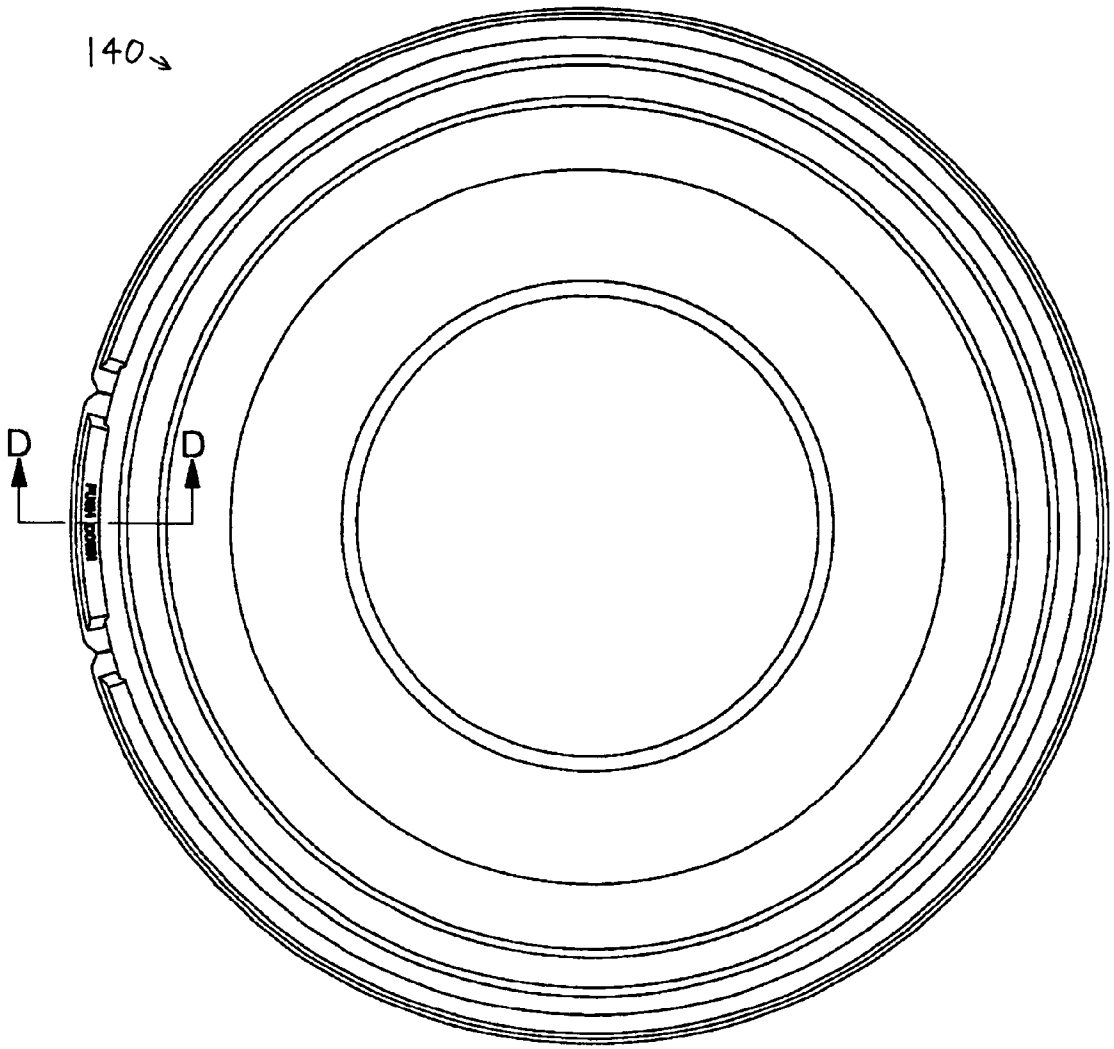
FIG. 13 is a plan view of the container of FIG. 12.
Figure 15:
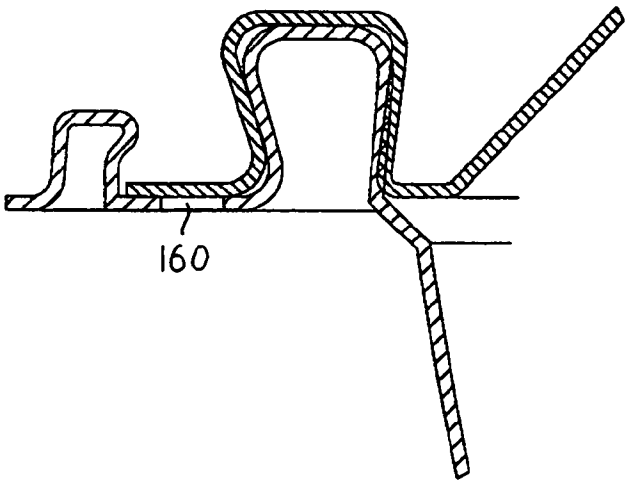
FIG. 15 is an enlarged view of area E-E of FIG. 14.
Figure 14:
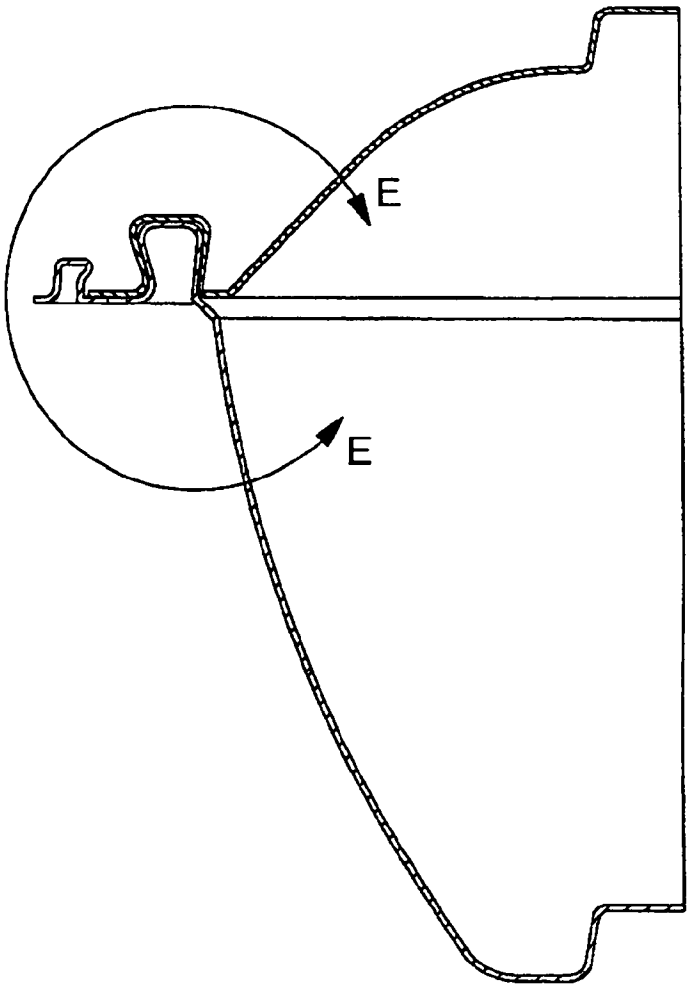
FIG. 14 is a sectional view taken on line D-D of FIG. 13.
Figure 17:
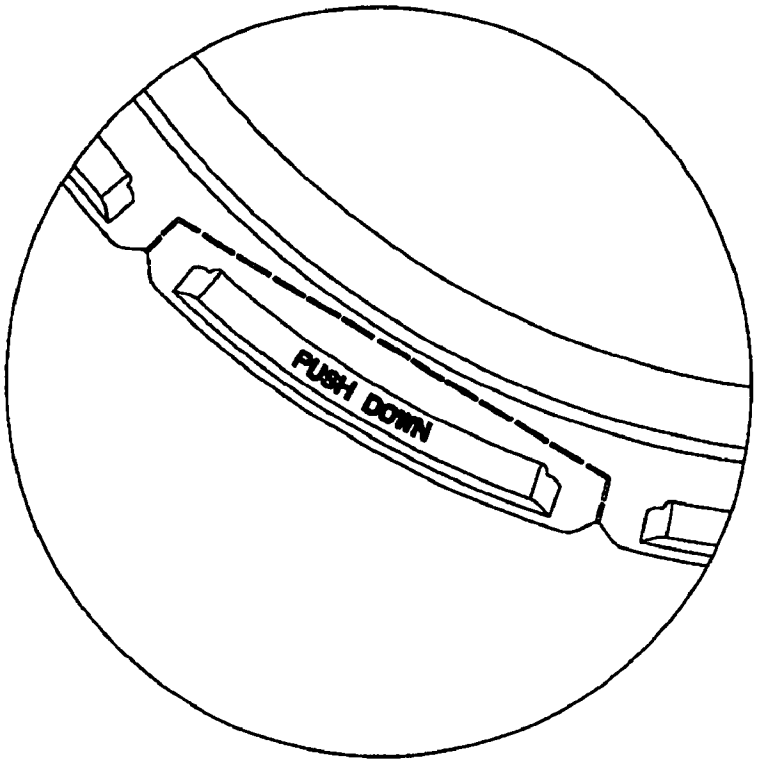
FIG. 17 is an isometric view of the base of a container of another variation of FIG. 11, wherein the separation line is a tear line.
Figure 16:
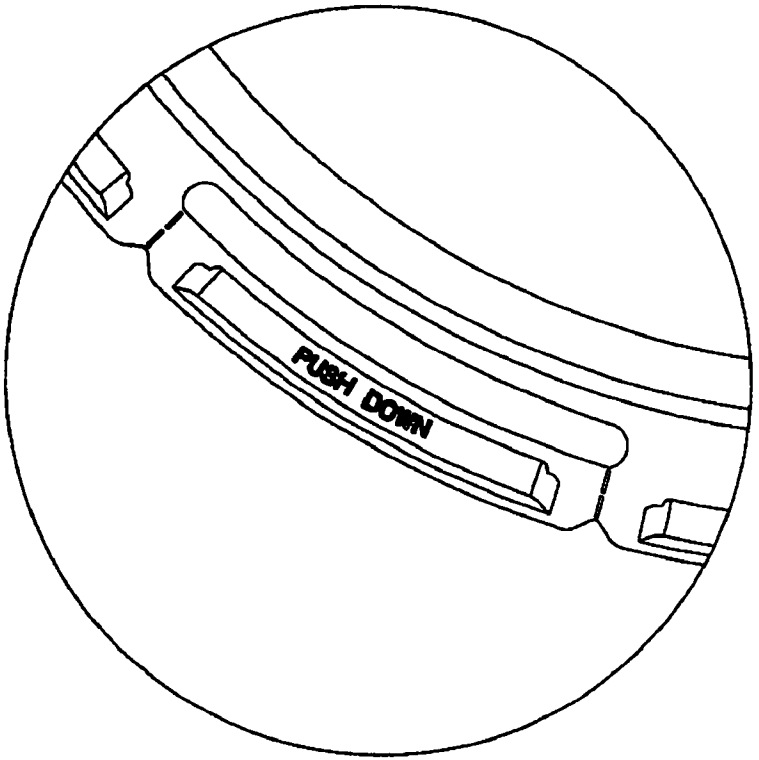
FIG. 16 is a partial isometric view of the base of a container that is a variation of FIG. 11, wherein the separation line is a wide slot and the gap lines at opposite sides of the tab are tear lines.

FIG. 11 shows a container 140 comprising a base 142 and lid 144 that have round peripheries centered on a container axis 146. The base forms a move-away tab 150 with gap lines 152, 154 at its opposite ends, and with a wide slot 160 that separates the tab from base portions that lie radially inward of the tab. FIG. 15 shows that the slot has a radial width of about 3 millimeters. The advantage of a wider slot is that the slot can be cut more reliably than a thin slot. However, as mentioned earlier, a wider slot allows someone to try to push up the lid by a projection pushed up through the slot. It is also possible to form the separation line as a tear line (FIG. 17) that can be easily torn, so a projection cannot be readily inserted up through the separation line.

The lids of FIGS. 1-17 can be closed at any orientation of the lid about the container axis (or at any of four orientations for the largely rectangular container of FIG. 1), with respect to the base. This facilitates closing of the containers.

Figure 18:
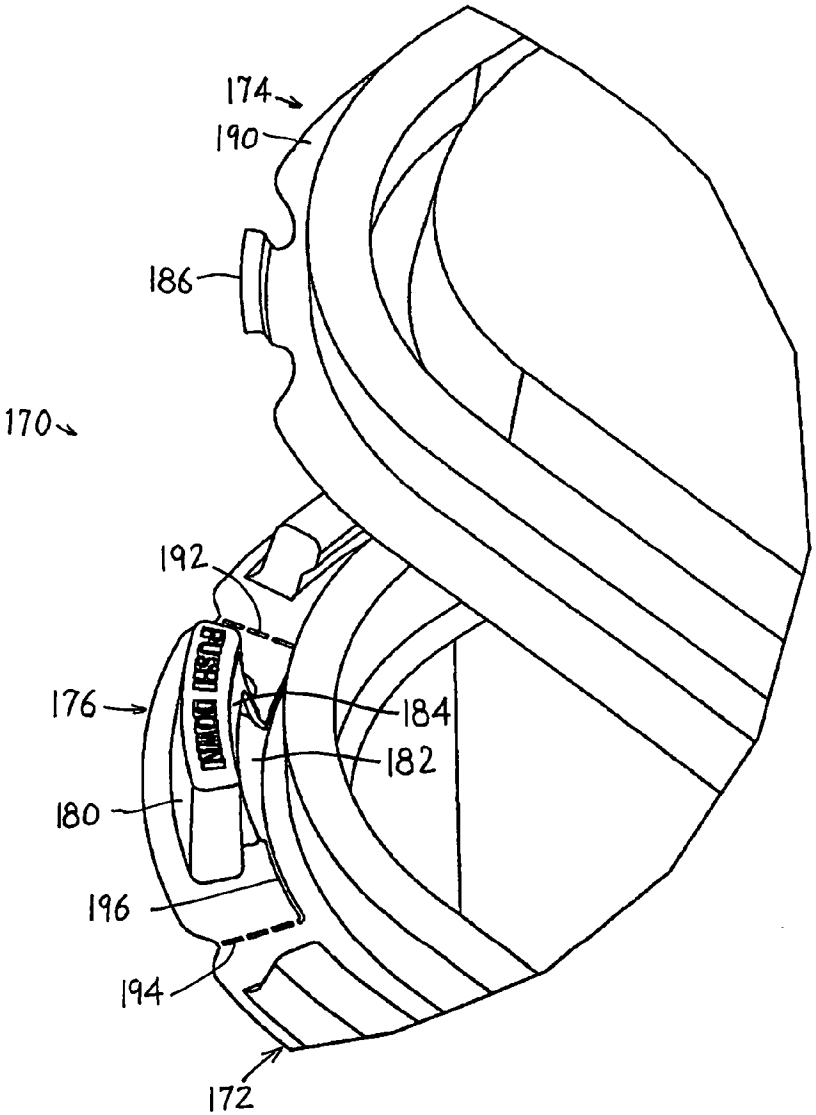
FIG. 18 is a partial isometric view of an opened container of another embodiment of the invention wherein a lid latch enters a base slot when the container is closed.
Figure 19:
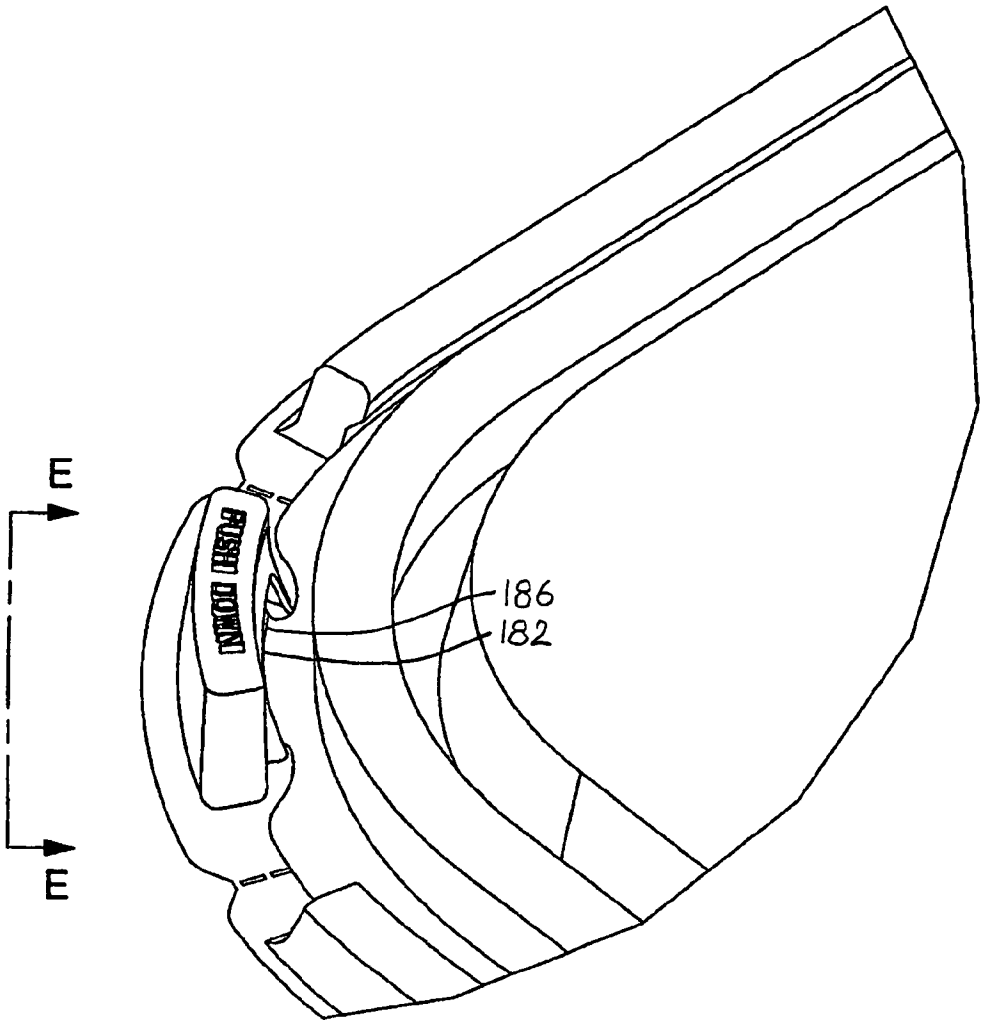
FIG. 19 is an isometric view of the region shown in FIG. 18, but with the container closed.
Figure 20:
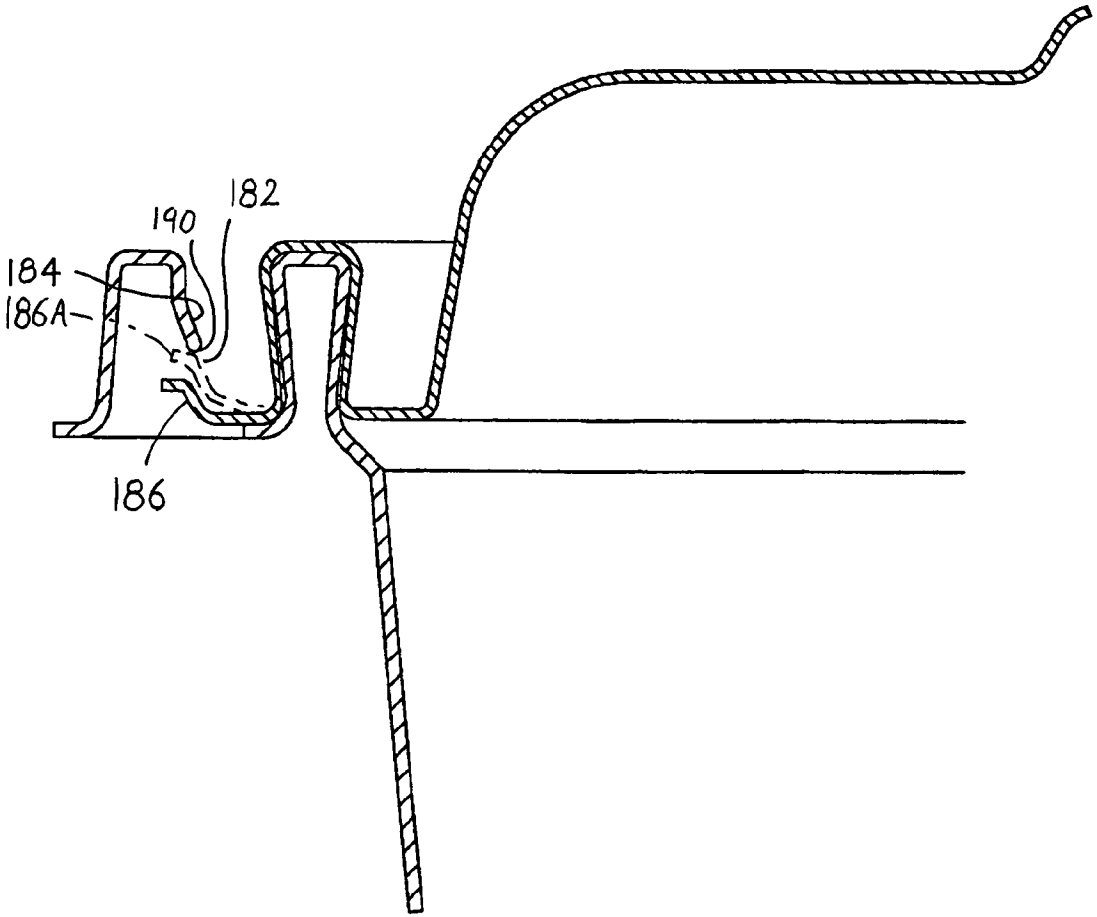
FIG. 20 is a sectional view taken on line E-E of FIG. 19.

FIG. 18 shows a portion of a container 170 with a base 172 and lid 174, wherein the base has a move-away tab 176 of different design. The tab has a base outer rib portion 180 with a slot 182 in its radially inner wall 184. The slot 182 receives a largely radially-outwardly projecting latch 186 of the lid rim part 190. When the lid is being closed, the latch is resiliently bent by the base inner wall 184 until the latch snaps into the slot 182. FIG. 19 shows the lid fully closed on the base, with the latch 186 received in the slot. FIG. 20 is a sectional view showing the latch 186 in the slot 182. The latch extends so far radially outward into the slot 182, that even if the latch is pushed upward and radially inward as to 186A, it is very difficult to move the latch up past the slot top edge 190. The tab can be moved out of the way to enable lifting the latch, by tearing one of the gap lines 192,194 (FIG. 18) so the fact that the container was opened is obvious. A narrow separation slit 196 is shown. Of course, one end of the move-away tab can have a hinge instead of a tear line that also serves as a hinge, and the separation line can have a tear line or a wide slot instead of a narrow slot.

Figure 21:
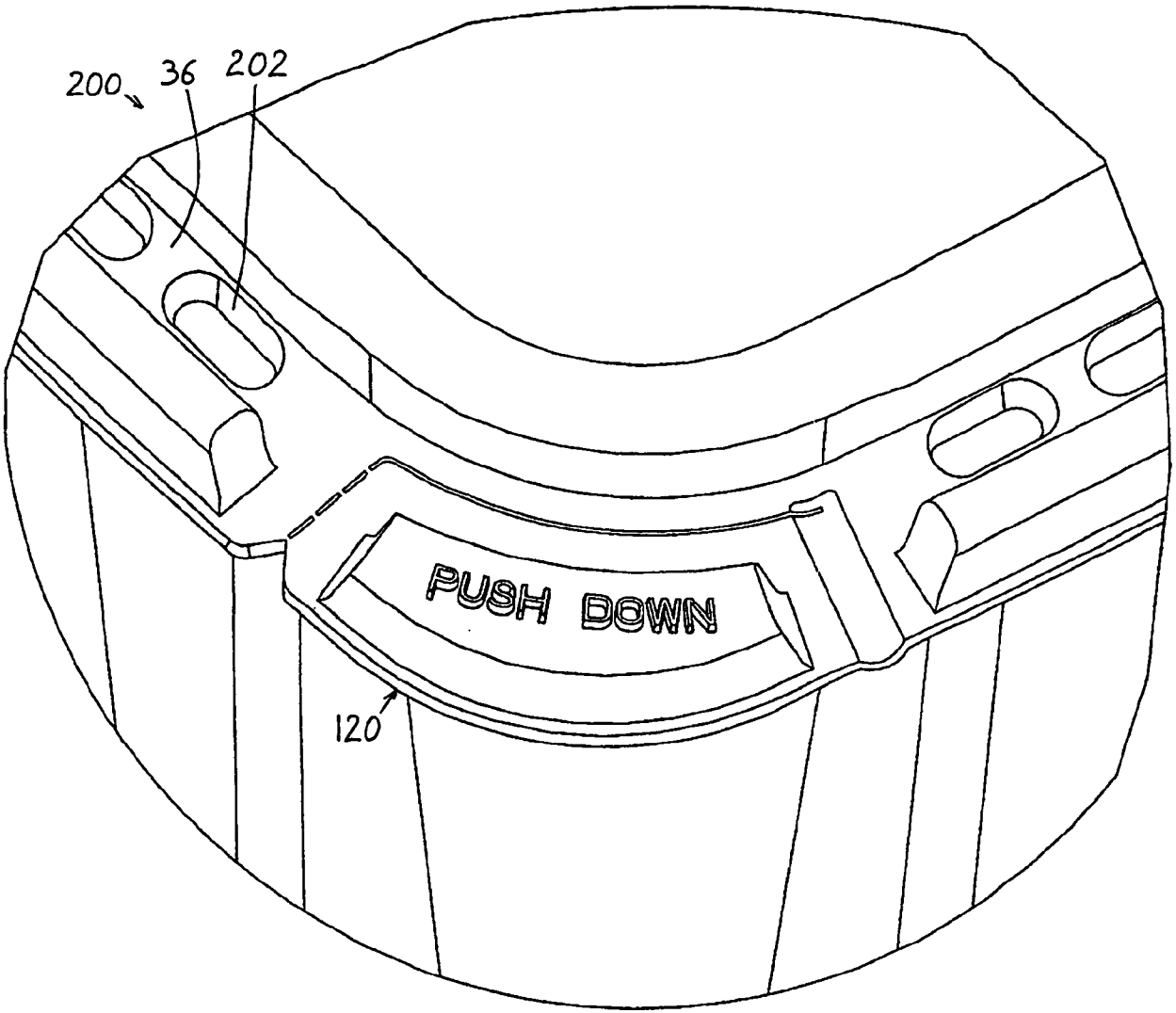
FIG. 21 is a partial isometric view of the base of a container similar to that of FIG. 8, but with the base support wall having dimples to rigidize it.

FIG. 21 shows a base 200 similar to the one in FIG. 8, but with the base support wall 36 having dimples 202. The dimples do not lie inward of the tab 120, and the dimples are covered by the lid when the container is closed. The dimples increase the rigidity of the base support wall.

The base and lid can be made from one of two pieces of sheeting, of a variety of materials. These include Oriented Polystyrene (OPS), Talc-Filled Polypropylene (TEPP), High Impact Polystyrene (HIPS), Polypropylene (PP), Polythylene Terepthalate (PET), Amorphous PET (APET), Crystallized Polyethylene (CPET), polyacid (PLA), Polystyrene, Styrene Block Copolymer blends as well as Biodegradable and Compostable Fiber materials. The sheet thickness is preferably 0.01 to 0.07 inch thick.

Thus, the invention provides a container wherein the lid can be easily closed on the base, and thereafter the container resists initial opening of the lid until a move-away tab is torn and moved out of the way so a lid rim part can be grasped to lift the lid. The base has a base outer rib with a vertically undercut inner wall that resists lid lift-up. There are gaps at circumferentially opposite ends of the tab, with gap lines in the gaps and with at least one of the gap lines being a tear line that can be torn. The base also has an upward projection formed by a radially inner rib, that fits into a groove in the lid to form a seal between them, with the seal lying above the food-holding cavity. In one type of container the lid has a lid rim portion of uniform shape around its entire periphery, and the lid can be installed in a plurality of positions turned about the container axis from one another. In another container, the lid has a projection at at least one location that fits into a slot in the radially inner wall of the tab.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container having a base and lid formed of at least one sheet, wherein said base and lid are centered on a vertical axis, wherein said base has a base rim portion with an upward-facing base support wall that extends at least 270° around said axis, and said lid has a lid rim portion with a lid rim part that lies on said base support wall, with said lid rim part having an outer lid rim edge, wherein:

said base rim portion has a raised base outer rib that lies immediately radially outside said base support wall, to block access to said lid rim part, said base outer rib extending along substantially the entire base rim portion except that said base outer rib has a pair of gaps;

said base rim portion has a primarily radial tear gap line lying in at least one of said gaps and has a pivot gap line lying in the other of said gaps and said base rim portion forms a primarily circumferentially-extending tab between said gap lines and along said base support wall;

said base rim portion also has a separable line extending primarily circumferentially between said gap lines and lying radially inward of said tab, so that after said tear gap line is torn said tab can be moved to expose the lid rim part between said gap lines.

2. The container described in claim 1 wherein:

said base outer rib has a radially inner side which is vertically undercut, and said lid rim edge lies below part of said raised outer rib inner side, to prevent the lid rim edge from being raised before the tear gap line is torn and the tab is moved.

3. The container described in claim 1 wherein:

said separable line that extends between said gap lines, is a slit having a radial width of no more than one millimeter, whereby to resist a person pushing up the lid rim part through the slit.

4. The container described in claim 1 wherein:

said separable line that extends between said gap lines, is a tear line that must be torn to separate and pivot said portion of said base rim.

5. The container described in claim 1, wherein:

said lid has a top that forms an upwardly-facing projection that is centered on said axis and that has horizontal width and length dimensions that are each more than one-third the diameter of said lid, and said base has a bottom wall with a lower surface forming an upward recess that closely receives said lid projection when a plurality of containers are stacked.

6. The container described in claim 1 wherein:

said raised base outer rib has a radially inner side with a radially inward opening slot with a slot top edge;

said lid rim part is formed with a radially-outwardly projecting latch that fits into said inward opening slot only by deflection of the latch.

7. The container described in claim 1 wherein:

said base support wall has a flat base upper surface, and said lid rim part has a flat lid lower surface that extends parallel to and adjacent to said flat base upper surface.

8. The container described in claim 1 wherein:

said base support wall has a base upper surface; said lid has a primarily vertical wall that lies radially inside said lid rim part to press said lid rim part firmly against said base upper surface.

9. The container described in claim 1 wherein: said base support wall has a plurality of dimples.

10. The container described in claim 1 wherein:

said base rim portion has a raised inner rib that is spaced radially inward of said raised base outer rib, with said base support wall extending between said raised outer rib and said raised inner rib;

said lid has walls forming a downwardly-opening lid groove that receives said raised base inner rib in an interference fit to form a seal thereat.

11. The container described in claim 10 wherein:

said raised base inner rib has radially inner and outer rib walls that each extends primarily vertically;

said walls forming a downwardly-opening lid groove include radially opposite inner and outer groove walls, said inner and outer groove walls extend primarily vertically and converge in downward direction and respectively engage said inner and outer rib walls of said raised base inner rib, whereby to hold down the lid and form a seal.

12. A container having base and lid elements formed of at least one sheet, wherein said base and lid elements are centered on a vertical axis, wherein said base element has a base rim portion and said lid element has a lid rim portion, wherein:

the rim portion of a first of said elements forms a largely vertical projection part with radially spaced inner and outer projection walls, said projection part extending at least 270°around said axis;

the rim portion of a second of said elements forms a largely vertical groove part that extends at least 270° around said axis and that receives said projection, said largely vertical groove having radially inner and outer groove walls that engage said inner and outer projection walls;

said base rim portion has a raised base outer rib radially outward of said projection part and of said groove part when the lid is closed on the base, and said base rim portion forms a horizontal base support wall extending between said base outer rib and the corresponding one of said projection and groove parts;

said lid has a lid rim part with a radially outer lid rim edge on said base support wall;

said base outer rib has a pair of circumferentially-spaced gaps, each of the gaps having a gap line defined therein, with one of said gap lines forming a gap tear line, and with a separation line radially inward of said base outer rib and extending between said gap lines, to allow access to said lid rim edge by moving a tab that lies radially outward of said separation line and between said gap lines.

13. The container described in claim 12, wherein:

said base forms said projection part with said projection part projecting upward and said lid forms said groove part with said groove part opening downward;

said radially inner and outer walls of said projection part converge in a downward direction and said radially inner and outer walls of said groove part converge in a downward direction, to help keep said lid closed on said base.

14. The container described in claim 12, wherein:

said base outer rib has a radially inner wall that is vertically undercut, and said radially outer lid rim edge is located close enough to said raised outer rib that when said tab has not been moved said inner wall of said base outer rib inhibits lifting said lid rim edge.

15. The container described in claim 12 wherein:

said base rim portion includes a horizontal base support wall, and said lid rim portion includes a lid rim part that lies adjacent to said base support wall, said lid rim part being connected by a curve to said groove radially outer wall and being pressed firmly against said horizontal base support wall.

16. A container having a base and lid formed of at least one sheet, wherein said base and lid are centered on a vertical axis, wherein said base has a base rim portion with an upward-facing base support wall that extend at least 270° around said axis, and said lid has a lid rim portion with a lid rim part that lies on said base support wall, with said lid rim part having an outer lid rim edge, wherein:

said base rim portion has a raised base outer rib that lies immediately radially outside said base support wall, to block access to said lid rim part, said base outer rib extending along substantially the entire base rim portion except that said base outer rib has a pair of gaps;

said base rim portion has a primarily radial tear gap line lying in at least one of said gaps and has a pivot gap line lying in the other of said gaps and said base rim portion forms a primarily circumferentially-extending tab between said gap lines and along said base support wall;

said base rim portion also has a separable line extending primarily circumferentially between said gap lines and lying radially inward of said tab, so that after said tear gap line is torn said tab can be moved to expose the lid rim part between said gap lines;

said base outer rib and said lid rim part form means for allowing said lid to close on said base and for thereafter preventing the lid from being grasped until said radial tear gap line is torn and said tab is moved out of the way of grasping said lid rim part to raise it.

17. The container described in claim 16 wherein:

said raised base outer rib has radially outer and inner sides with said radially inner side having a slot that opens radially inward, said slot having a slot top edge;

said lid rim part is formed with a radially-outwardly projecting latch that fits into said inward opening slot by upward and inward deflection of the latch as said cover is closed.

18. The container described in claim 16 wherein:

along the length of said tab said base outer rib has a radially outer side, and said base outer rib has a radially inner side with a lower portion and with an upper portion that overhangs the lower portion so said radially inner side is vertically undercut, and said lid rim edge lies below said overhang of said rib inner side to prevent the lid rim edge from being raised before the tear gap line is torn and the tab is moved.

19. A container having a base and lid formed of at least one deformed sheet of material, wherein said base and lid are centered on a vertical axis, wherein said base has a base rim portion and said lid element has a lid rim portion, wherein:

said base rim portion has a base support wall with an upper surface, and said lid rim portion has a lid rim part with a lower surface that extends parallel to and against said base upper surface when said lid has been closed on said base;

said base rim portion has an upward base rib that lies radially outward of said lid rim part to block access to said lid rim part, said lid rim part having tab means for providing access to said lid rim part and for indicating that such access has been provided.

20. The container described in claim 19 wherein:

said tab means comprises a pair of gaps in said base rib, primarily radially extending gap lines extending along each of said gaps with one gap line being a tear line and the other being pivotable, and with a separation line extending circumferentially between radially inner ends of said gap lines, said separation line lying radially inward of part of said lid rim part.

* * * * *